United States Patent [19]

Abramson et al.

[11] 4,067,129

[45] Jan. 10, 1978

[54] DISPLAY APPARATUS HAVING MEANS FOR CREATING A SPECTRAL COLOR EFFECT

[75] Inventors: Allan P. Abramson, Upper Montclair; John G. Dewees, Morristown; Richard J. Lasky, Clifton, all of N.J.

[73] Assignee: Trans-World Manufacturing Corporation, Little Ferry, N.J.

[21] Appl. No.: 736,541

[22] Filed: Oct. 28, 1976

[51] Int. Cl.[2] ..... G09F 13/06

[52] U.S. Cl. ..... 40/563; 40/581; 40/137; 40/454

[58] Field of Search ..... 40/132 E, 132 F, 132 G, 40/132 R, 137, 130 R, 106.52, 106.53, 219, 133 A, 130 L; 240/10 R, 10.1

[56] References Cited

U.S. PATENT DOCUMENTS

| | | | |
|---|---|---|---|
| 859,199 | 7/1907 | Chinnery | 40/133 A |
| 3,538,323 | 11/1970 | Ziegler | 240/10.1 |
| 3,805,049 | 4/1974 | Frank et al. | 40/130 L X |
| 3,806,722 | 4/1974 | Peake et al. | 240/10 R |
| 3,840,732 | 10/1974 | Cohen | 240/10 R |

FOREIGN PATENT DOCUMENTS

| | | | |
|---|---|---|---|
| 445,424 | 9/1927 | Germany | 40/137 |
| 314,533 | 6/1929 | United Kingdom | 40/137 |

*Primary Examiner*—John F. Pitrelli

*Attorney, Agent, or Firm*—Ostrolenk, Faber, Gerb & Soffen

[57] ABSTRACT

Display apparatus including a display surface containing advertising and/or other informative or decorative matter and having at least portions thereof slotted or transparent. Diffraction grating means are positioned to the rearward side of the display surface and means are provided for illuminating the diffraction grating in order to create a color spectrum effect which is projected through the aforesaid transparent openings or slots, creating a highly aesthetically-pleasing effect, the distribution of the colors being changed with changes in position of the viewer. The openings may preferably be in the form of symbol or a composite thereof. The opaque regions of the display surface may, in one preferred embodiment, be reflective.

11 Claims, 4 Drawing Figures

DISPLAY APPARATUS HAVING MEANS FOR CREATING A SPECTRAL COLOR EFFECT

BACKGROUND OF THE INVENTION

The most significant aspect of a display apparatus is its ability to "catch the eye" of a passing observer to thereby draw the attention of the observer to the message desired to be conveyed, such as, for example, the sale of a product, a service, or the like.

In addition thereto, it is highly desirable that these objectives be capable of being accomplished through display means which, in addition to being aesthetically appealing, is of a simple design (i.e., preferably no moving parts whatsoever) and structured so as to be inexpensive and yet provides a display of good quality and good artistic design.

BRIEF DESCRIPTION OF THE INVENTION

The present invention is characterized by providing a display means which while highly simplified in design, nevertheless provides a display message which is aesthetically appealing and dynamic in nature in that the spectral color effect thereof is highly aesthetically appealing and changes with changes in position of the observer relative to the display.

The display is characterized by comprising a display surface having slots, transparent portions or the like, which are preferably arranged to define a word, symbol, picture or composite thereof. A rearwardly mounted enclosure enshrouds the rearward side of the display surface defining a substantially hollow interior therein. The surface of all or a major portion of the enshrouding cover has formed thereon or otherwise affixed thereto, a diffraction grating formed of a highly reflective material. The diffraction grating comprises a series of narrow slits or grooves which by diffracting light produces a large number of beams which interfere in such a manner as to produce spectra. At least one light source is positioned within the aforesaid hollow interior and emits omnidirectional light, most of which impinges upon the diffraction grating surface so as to be split into the visible light spectrum. The spectal light reflected from the difraction grating passes through the transparent or slotted portions of the display surface creating an effect which has a highly aesthetic appearance to the observer and covering the entire visible light spectrum. The display apparatus provides an additional dynamic impact in that the various colors change position relative to one another and relative to the observer as the relative position between observer and display changes, thereby creating an effect which is very appealing and interesting to the eye of the observer, thereby (subtlely, or otherwise) serving to draw the attention of the observer to the message arranged upon the display. An additional attractive effect results from the display when its message carrying surface, or at least portions thereof, is mirrored (i.e., highly reflective) so that the warmth or atmosphere of the region in which the display structure is positioned is projected upon the display itself and reflected back to the observer creating a total effect which the observer finds it very difficult to turn his attention away from.

In another alternative embodiment, two or more light sources may be employed and may be illuminated in an alternating or sequential fashion so as to enhance the overall effect of the display. The light sources may be of differing colors or, alternatively, one lamp may be employed and a rotating disc with different color filters may be arranged to cooperate with the light source, thereby contributing an added dimension to the overall display effect.

OBJECTS OF THE INVENTION

It is therefore one object of the present invention to provide a novel display arrangement in which the display surface has at least portions thereof cut away or otherwise transparent, and in which means are provided for passing diffracted light therethrough to create a highly colorful effect which is dynamic in the sense that the position of the colors change as the position of the observer changes relative to the display.

Still another object of the present invention is to provide a display of the type described hereinabove wherein at least portions of the display surface are mirrored to add still another dimension to the overall aesthetically-appealing effect created by the display structure.

BRIEF DESCRIPTION OF THE FIGURES

The above as well as other objects of the present invention will become apparent when reading the accompanying description and drawings in which.

DETAILED DESCRIPTION OF THE INVENTION

Figure 1:
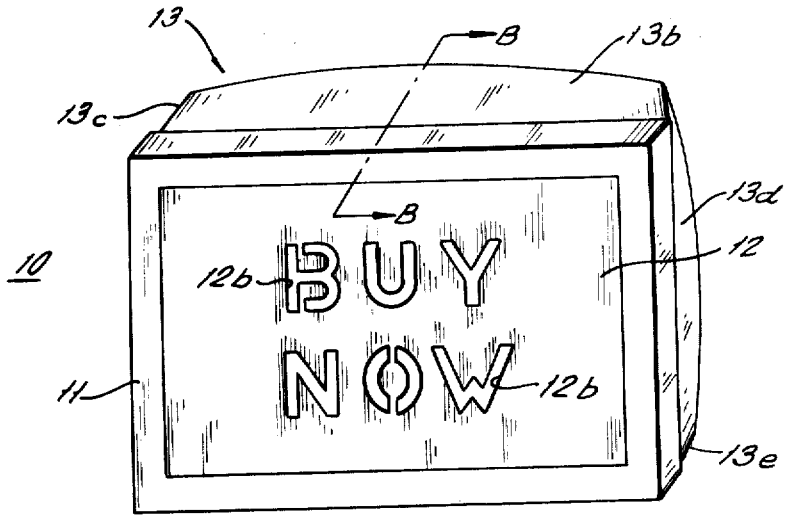
FIG. 1 is a perspective view of a display embodying the principles of the present invention.
Figure 1A:
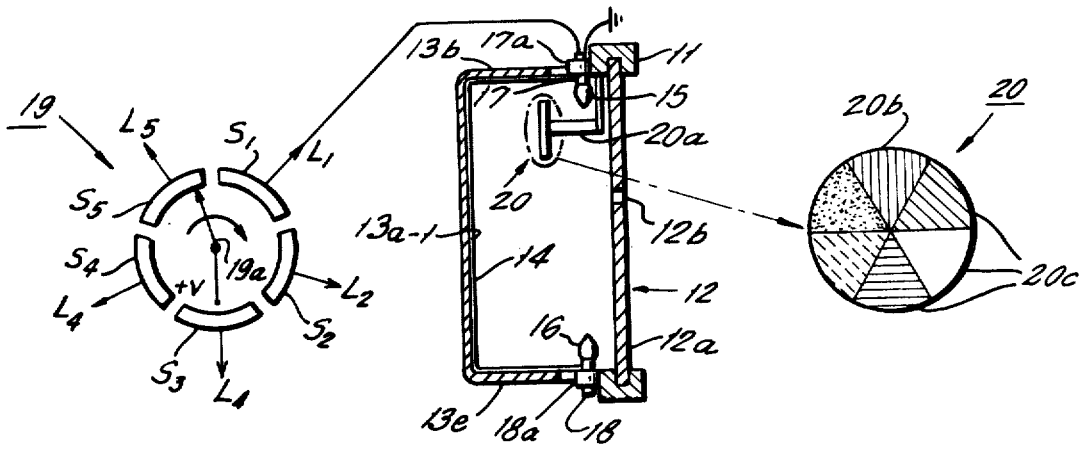
FIG. 1*a* shows a top plan view of the apparatus of FIG. 1.
Figure 1B:
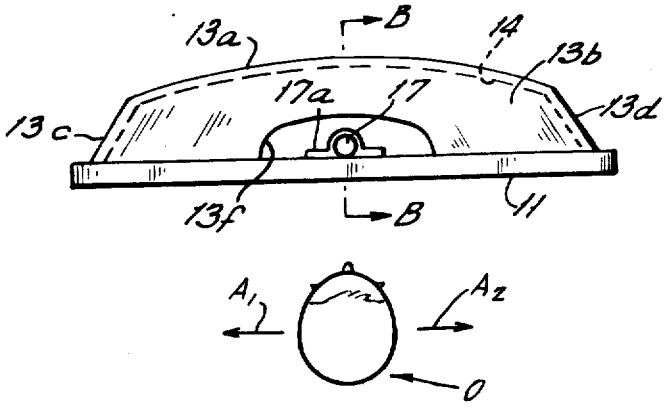
FIG. 1*b* shows a sectional view looking in the direction of arrows B—B of FIGS. 1 and 1*a*.

FIGS. 1 through 1*b* show a display apparatus 10 comprised of a frame 11 of substantially rectangular shape and having embraced therein a sheet, plate or display member 12 whose front surface 12*a* (note FIG. 1*b*) is preferably either mirrored or a major portion thereof is mirrored, and which is cut away at 12*b* (not FIG. 1) so as to form the words "BUY NOW".

An enclosure 13 is provided to the rearward side of display member 12 and is comprised of a central portion 13*a* having a slightly curved contour and top 13*b* and sides 13*c* and 13*d* as well as the bottom 13*e* and are joined by an adhesive or other suitable means to the rearward side of frame 11. The top and bottom portions 13*b* and 13*e* are each provided with cut-outs, such as, for example, the cut-out 13*f* to enhance air circulation for the purpose to be more fully described. The entire inner surface of central portion 13*a* and preferably the interior surfaces of portions 13*b*, 13*c*, 13*d* and 13*e* are covered with a sheet-like material 14, having a diffraction grating pattern thereon, and which is adhesively adhered to said surfaces and is adapted to diffract light emitted from lamps 15 and 16, as well as to reflect the light so that the diffracted reflected light passes through the transparent or cut-away opening portions 12*b* in display member 12 so that an observer O upon observing the display, sees the diffracted light passing through the openings forming the message "BUY NOW" creating an extremely aesthetically appealing effect, the colors being viewed therethrough covering the entire spectrum of visible light.

In addition thereto, it has been found that if the observer O changes position relative to the display, i.e., for example moves either in the direction of arrow $A_1$ or arrow $A_2$, it is found that the colors of visible light covering the entire visible spectrum and passing through openings 12b change position relative to the observer, and relative to one another, creating a highly dynamic effect as a result thereof. In addition thereto, it is found that if the regions surrounding the message formed by the cut-outs 12b and on surface 12a are mirrored, the ambience of the room or region in which the display is arranged is reflected from the display back to the observer creating an additional dimension to the overall display.

As shown, each lamp 15 and 16 is secured to the frame 11, for example, by a bracket 17 and 18 respectively with leads being directed from the lamp socket 17a and 18a mounted within each bracket 17 and 18 to a suitable energy source. The slots, such as 13f, prevent the lamps 15 and 16 from overheating.

If desired, the lamps may be illuminated in an alternating fashion, for example, by use of the motor driven rotary switch 19 shown in FIG. 1b wherein the rotary arm 19a is rotated either clockwise, or counter-clockwise, so as to make wiping engagement with segments $S_1$ through $S_5$, each one of these segments having a lead $L_1$-$L_5$ electrically connected to one lead of a lamp socket, the other socket lead being connected to ground. A positive voltage source may be connected to the central terminal of the rotating arm 19a to create a completed electrical circuit. For example, as another alternative embodiment, each of the segments $S_1$ through $S_5$ of the rotary switch may be electrically connected to one of five different lamps, and hence a greater number of lamps than two may be employed. In addition thereto, the lamps may be of different colors or, alternatively, a filter wheel such as, for example, the filter wheel assembly 20 comprised of a shaft 20a mounting filter wheel 20b having pie-shaped portions 20c each of a different color and adapted to rotate so as to position each portion thereof of each different color relative to lamp 15 to create another dimension or an impact upon the observer to further enhance the attractiveness of the display to the observer.

Figure 2:
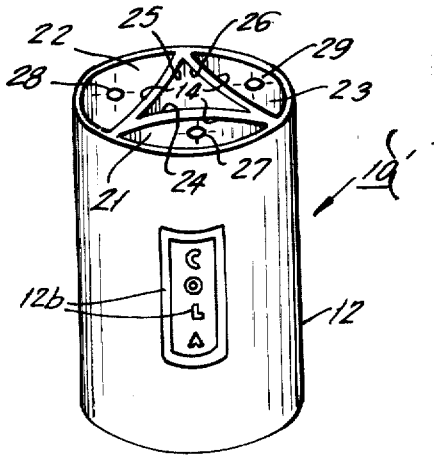
FIG. 2 shows a perspective view of a second embodiment of the present invention.

In the embodiment illustrated in FIG. 2, the display member 12 is cylindrical in shape and has transparent portions 12b defining the outline of a picture such as a soda can. Similar informative or decorative material may be included on other portions of display member 12 around the entire periphery thereof. Display apparatus 10' is separated into three separate sections 21, 22 and 23 by interior walls 24, 25 and 26, each covered with a sheet-like material 14. While material 14 (both in the embodiment of FIG. 2 as well as the embodiments of FIGS. 1-1b) preferably has a diffraction grating pattern thereon, other reflective surfaces such as mylar may be used if they create a desired visual effect. Each section 21, 22 and 23 includes a lamp 27, 28 or 29 which may be provided with an appropriate color wheel as shown in FIG. 1a. While display apparatus 10' has been illustrated without a top cover for ease of description, a suitable cover will normally be provided.

Although the present invention has been described in connection with preferred emobidments thereof, many variations and modifications will now become apparent to those skilled in the art. It is preferred, therefore, that the present invention be limited not by the specific disclosure herein, but only by the appended claims. For example, the cut-out portions 12b may be clear or transparent material, i.e., glass or plastic. The cut-out portion instead of forming the letters may form a border around the letters or even the major portion of the background that the message is set upon. The message may also be arranged so that only a portion thereof serves as the means for communicating the spectrum of visible light therethrough while the remainder of the message is formed upon the opaque surface in a color which contrasts sharply and aesthetically with the surface 12a, which may be a reflective or mirrored surface as referred to hereinabove.

What is claimed is:

1. A display apparatus comprising:

a mirrored front surface having transparent portions formed therein, said transparent portions cooperating with said mirrored front surface to define a message being presented;

a diffraction grating comprising a series of narrow slits or grooves which, by diffracting light, produce a large number of beams which interfere in such a manner as to produce spectra;

a housing for positioning said diffraction grating behind and spaced from said front surface;

a light source mounted on said housing in a position which will cause light produced thereby to impinge on and be diffracted by said diffraction grating whereby said light is diffracted into substantially all of the colors of the visible spectrum;

said light source and diffraction grating being positioned within said housing in such a manner that said light diffracted by said diffraction grating passes through said transparent portions of said mirrored front surface, whereby the colors viewed by an observer of said apparatus change as the observer changes position relative to said mirrored front surface.

2. The display apparatus of claim 1 wherein said transparent portions define a word or words.

3. The display apparatus of claim 2 wherein said mirrored front surface further includes colored portions which define a further portion of the message being presented.

4. The display apparatus of claim 1 wherein said housing comprises a display member defined by said mirrored front surface and a second member positioned a spaced distance from said display member and wherein said second member is provided with end flanges surrounding the periphery thereof, said flanges being bent towards and engaging the rearward side of said display member so as to form a hollow box-like structure;

said light source being housed within the hollow interior of the box-like structure;

said light source being positioned behind a mirrored portion of the display member to prevent direct light from the light source from passing through the transparent portions of the display board.

5. The display apparatus of claim 4 wherein the entire interior surface of said second member, including said flanges, is covered with said diffraction grating.

6. The display apparatus of claim 1 wherein said message includes one or more words formed upon the display surface; and said transparent portion defining a border around selected ones of said words.

7. The display apparatus of claim 1 wherein additional informational material is formed on said mirrored front surface, said additional material cooperating with said transparent portions to form a composite message.

8. The apparatus of claim 1 wherein said light source is one of a plurality of light sources are arranged at spaced locations from said mirrored front surface intermediate said mirrored front surface and said diffraction grating;

means for selectively illuminating said plurality of light sources in a predetermined pattern to cause said spectral light pattern to change.

9. The display apparatus of claim 8 wherein each of said plurality of light sources is adapted to emit light of a different color.

10. The display apparatus of claim 1 further comprising a filter wheel and means for rotating said wheel;

said wheel being positioned between said light source and said diffraction grating and being comprised of filter members of different colors and cooperating with the light source to sequentially change the color of the light impinging upon said diffracting grating.

11. The display apparatus of claim 1 wherein said display member is cylindrical in shape.

* * * * *